United States Patent [19]

Blum

[11] 4,101,885

[45] Jul. 18, 1978

[54] MUSICAL CHIME DEVICE

[76] Inventor: Emil Blum, 4143 N. Ocean Blvd., Fort Lauderdale, Fla. 33308

[21] Appl. No.: 807,922

[22] Filed: Jun. 20, 1977

Related U.S. Application Data

[63] Continuation of Ser. No. 607,834, Aug. 26, 1975, abandoned.

[51] Int. Cl.[2] ..... G08B 3/00

[52] U.S. Cl. ..... 340/384 E; 340/384 R; 84/1.01

[58] Field of Search ..... 58/12, 13; 84/1.28, 84/1.18, 1.01; 340/384 E, 384 R

[56] References Cited

U.S. PATENT DOCUMENTS 3,424,851 1/1969 Weitzner ..... 84/1.28

*Primary Examiner*—Harold I. Pitts
*Attorney, Agent, or Firm*—Malin & Haley

[57] ABSTRACT

An electronic musical chime device for doors and clocks. The musical chime device includes a printed board circuit or a melody circuit board or musical card having electrical contact areas arranged in a sequential manner corresponding to the musical score of a melody. A tone generating circuit connected to and controlled by the printed board circuit. A movable connecting means sweeps over the contact areas to ground the control circuit. The amplifier and speaker are connected to the tone generating circuit to produce the musical sounds in a melody corresponding to the positioning of the contact areas on the printed board circuit and the speed of the connecting means. The printed board circuit is replaceable to provide various melodies when a main on-off switch is actuated.

4 Claims, 6 Drawing Figures

Input
20
46
48
50
6
28
51
52
53
54
55
56
57
58
59
60
61
62
63
64
65
66
67
68
C
C#
D
D#
E
F
G
G#
A
A#
B
F#

MUSICAL CHIME DEVICE

This is a continuation of application Ser. No. 607,834 filed Aug. 26, 1975, now abandoned.

BACKGROUND OF THE INVENTION

In the past, many musical sound devices for door chimes and musical clocks have been mechanical devices that are costly to manufacture. Most of these mechanical devices are not designed and manufactured to produce different melodies. The present invention provides a plurality of changeable printed board circuits of varying melodies. The selected melody on the printed board circuit is placed in the musical clock or door chime device. The selected melody is sounded automatically at certain intervals triggered by a switch within the musical clock or it is triggered by pressing the door pushbutton switch.

BRIEF DESCRIPTION OF THE INVENTION

This invention relates to a musical chime device that may play one or more of a plurality of selected melodies. The musical chime device includes a switch means connectable to a power source, a power circuit connected to the switch means, a tone generating circuit connected to the power circuit, a musical card or printed board circuit having a number of metallic contact areas of varying length and of varying spacing from adjacent contact areas connected to conducting paths to the edge connector or terminal, the printed board circuit terminals are connected to the tone generating circuit, to activate some or all of the various frequencies that may be produced in the tone generating means, movable connecting means for sweeping over the contact areas and grounding the tone generating circuit, amplifier means connected to the output of the tone generating circuit, and a speaker connected to the amplifier means for producing the melody on the particular printed board circuit.

The edge connector of the printed board circuit is wired so that the movable connecting means will ground the tone generating circuit in order to actuate the audio oscillator to provide an output to the amplifier means and the speaker in a manner to provide an output melody. The length of each contacting area on the printed board circuit and the spacing between each adjacent area and the speed of the movable connecting means in conjunction with the generator determines the particular melody to be played. The length of the contact areas for a full note of the musical score may be twice as long as a half note or four times as long as a quarter note. Notes of various lengths may be produced. The length of the pause or spacing between contact areas are proportioned by varying the length of the spacing to provide the proper melody. The contact areas may be positioned in a circular path to be easily swept by a rotating contact arm driven by a motor. The motor slowly rotates the arm at a particular speed to place the distal end of the arm with contact means in position to make electrical contact with each contact area on the printed board circuit, in order to cause the audio tone to be heard in the same sequence as the melody of the musical score on the printed board circuit. The melody may be changed by simply removing the printed board circuit and replacing it with a printed board circuit having a different contact area pattern and spacing to produce a new melody. The printed board circuit may have varying circuit terminal connections to vary the frequency of the oscillations produced at the output of the tone generator.

It is an object of this device to produce interchangeable short melody card or record in the form of a printed board circuit.

Another object of this invention is to produce a melody card having contact areas sized and spaced to provide the length, sequence and pauses between the tones being played.

Another object of this device is to provide pull out replaceable printed circuit board melody card that selects the tone to be reproduced.

A further object of this device is to provide a door chime device having an interchangeable short melody record.

A further object of this invention is to provide a door chime device having a pull out replaceable printed circuit board melody record.

A further object of this device is to provide a clock chime device having an interchangeable short melody record.

A further object of this invention is to provide a clock chime device having a pull out replaceable printed circuit board melody record.

In accordance with these and other objects which will be apparent hereinafter, the instant invention will now be described with particular reference to the accompanying drawing.

DESCRIPTION OF A PREFERRED EMBODIMENT

Figure 1:
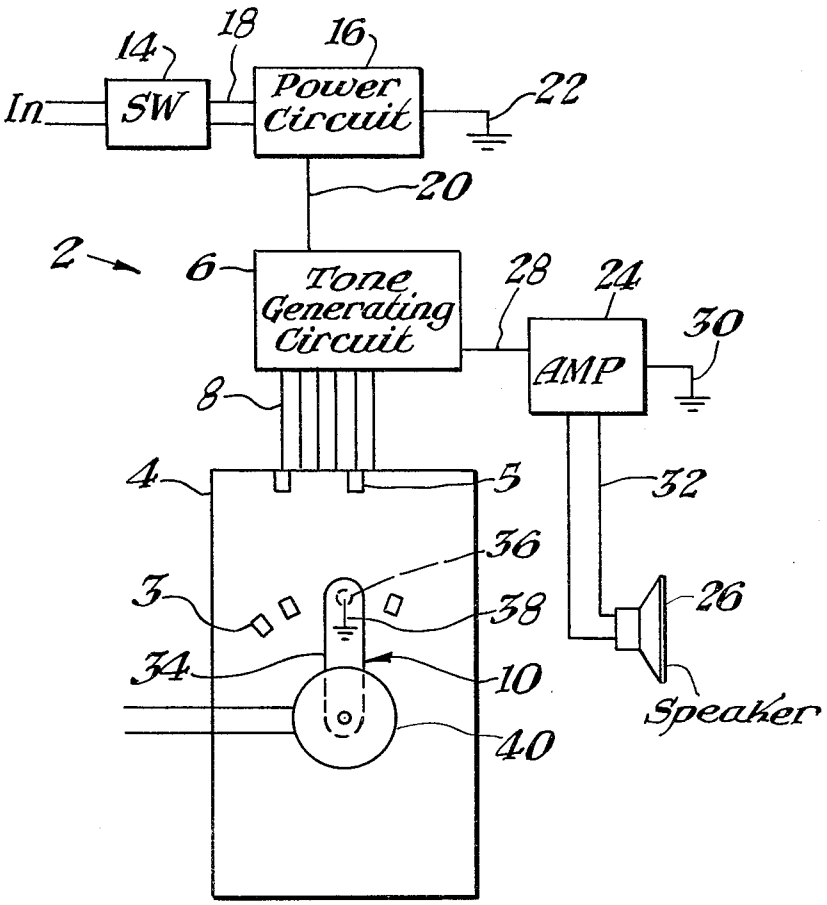
FIG. 1 is a block diagram of the electronic musical chime device.

Referring now to the drawings, FIG. 1 is a block diagram of the musical chime device, generally designated by numeral 2, that includes power source or input connected to a switch 14 by input means or input lines, a power circuit means 16 connected to the input by lines 18, the power circuit is grounded by line 22, and a tone generating circuit means 6 connected to the power circuit means 6 by line 20. The device 2 includes a printed board circuit means or melody board circuit 4 connected to the tone generating circuit means 6 by the tone selecting contacts 5. The tone generating circuit means 6 includes a plurality of leads 8 connectable to the tone selecting contacts 5. The device 2 includes an amplifier means 24 connected to the tone generating circuit means 6 by lead 28, the amplifier 24 is grounded by lead 30, and an audio speaker circuit 26 is connected to said amplifier means by leads 32. A switch means 14 may be remotely connected to a door means for activating the musical chime device in the form of a door chime. A switch means 16 may be connected into a clock mechanism for activating the musical chime device in the form of a clock chime.

The melody circuit board or printed circuit board 4 includes electrical contact areas or melody control means or melody circuit 3 of varying length arranged in a sequential manner corresponding to the musical score of a melody. The contact areas 5 are connected to the tone selecting contacts or edge connectors 5. A movable connecting means 10 is used to sweep over the contact areas 3 on the printed circuit board 4.

In use, as the arm 34 of the movable connector means 10 sweeps the melody circuit board 4, contact areas 3, a musical tone is played in a melody corresponding to the positioning and speed of the contact point 36 over the contact areas 5 of printed circuit board 4 and the selection of tone by edge connectors 5. The contact point 36 is grounded through line 38. The arm 34 is driven by motor 40 that is connected to a power source.

The printed circuit board 4 is easily replaced to provide various melodies. This invention therefore provides a plurality of interchangeable melody circuit boards of playing a variety of melodies. The selected melody on the printed board circuit is placed in the musical clock or door chimes device and connected to the tone generating circuit 6. Switch 14 may be triggered directly or may be triggered by a musical clock means.

Figure 2:
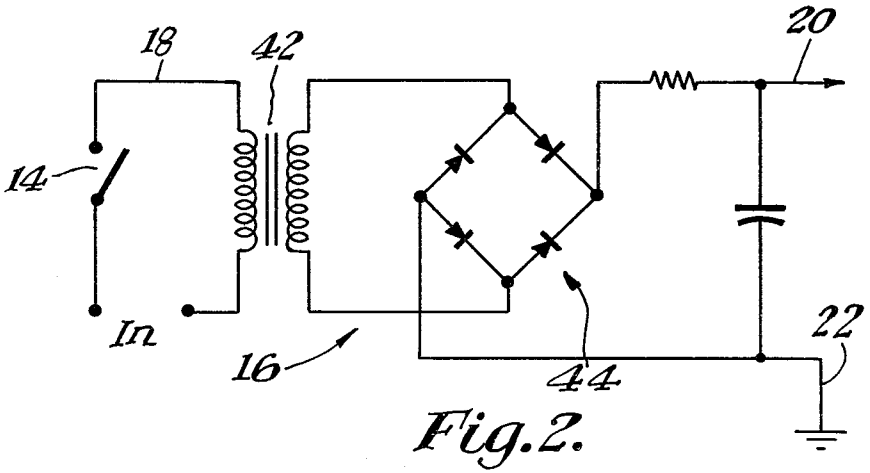
FIG. 2 is a schematic diagram of the power supply circuit.

Referring to FIG. 2 showing switch 14, lines 18 and power circuit 16, the power circuit includes transformer 42 and rectifier circuit 44 connected to the tone generating circuit means line 20 and ground line 22.

Figure 3:
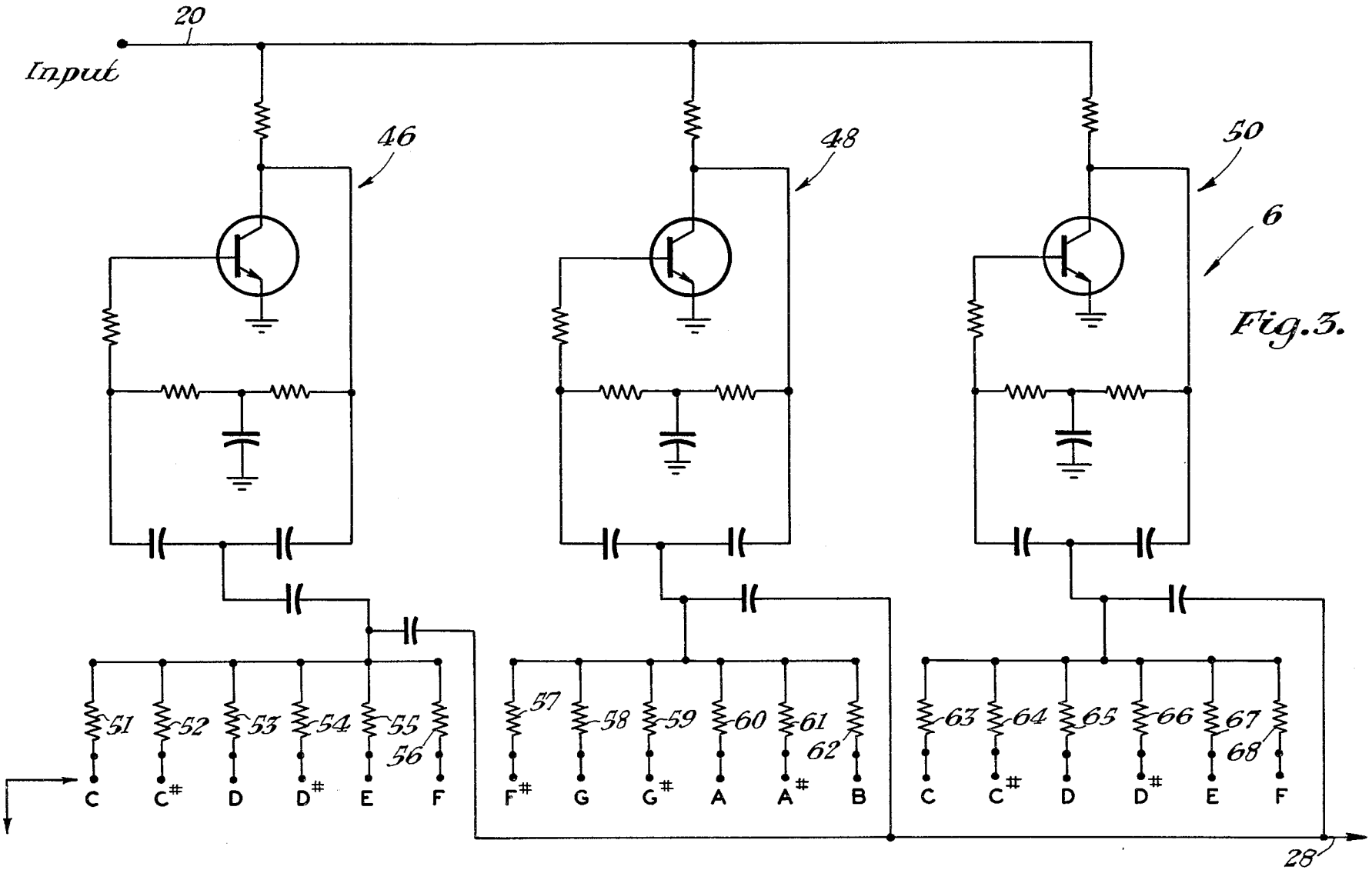
FIG. 3 is a schematic diagram of the tone generating circuit.

In FIG. 3, input line 20 is connected to three oscillators 46, 48 and 50. The output from the oscillators are connected to line 28 that is connected to amplifier 24. A plurality of resistors 51 through 56, 57 through 62 and 63 through 68 are connectable to the printed board circuit 4 in order that they may be selectively grounded to provide a particular tone from the particular oscillator. The connection of resistors 51 through 68 to ground will produce notes or tones in the chromatic scale such as C4, C#, D, D#, E, F, F#, G, G#, A, A#, B, C5, C#, D, D#, E and F respectively.

Figure 4:
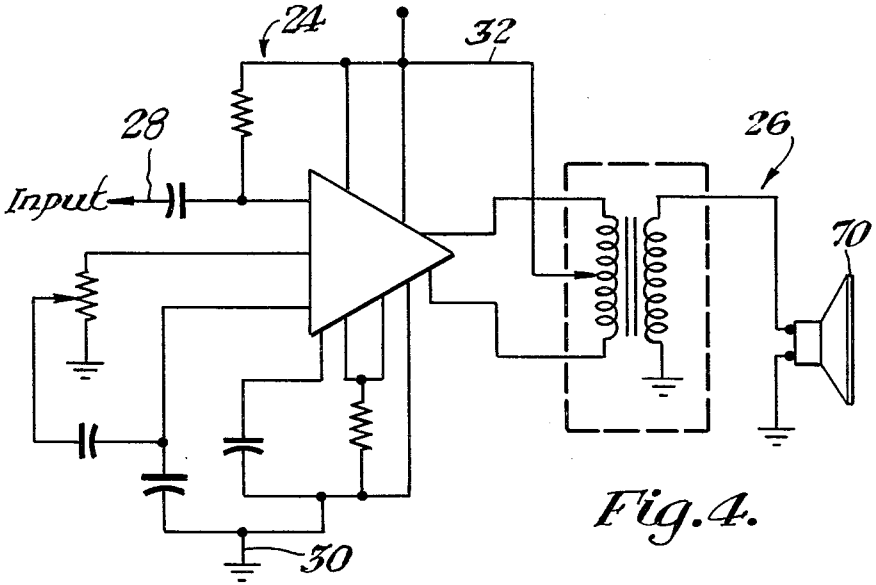
FIG. 4 is a schematic diagram of the amplifier and speaker circuit.

Referring to FIG. 4, the amplifier 24 has an input 28 and output 32. The amplifier 24 is grounded by lead 30. Speaker circuit 26 includes input leads 32 and speaker 70.

Figure 5:
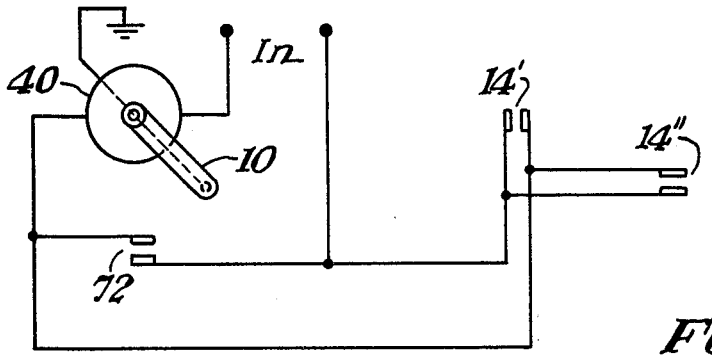
FIG. 5 is a schematic diagram of the motor trigger circuit.

FIG. 5 shows the motor circuit including motor 40 driving arm 10. The motor is connected to a power source by input leads. A clock switch 14' or 14'' are placed in parallel with a micro-switch 72 that may be held in a closed position by a motor cam, not shown, during the full cycle of operation of the motor. The motor cam is connected to motor 40. The micro-switch automatically turns the motor and the device off after completion of a full cycle of operation.

Figure 6:
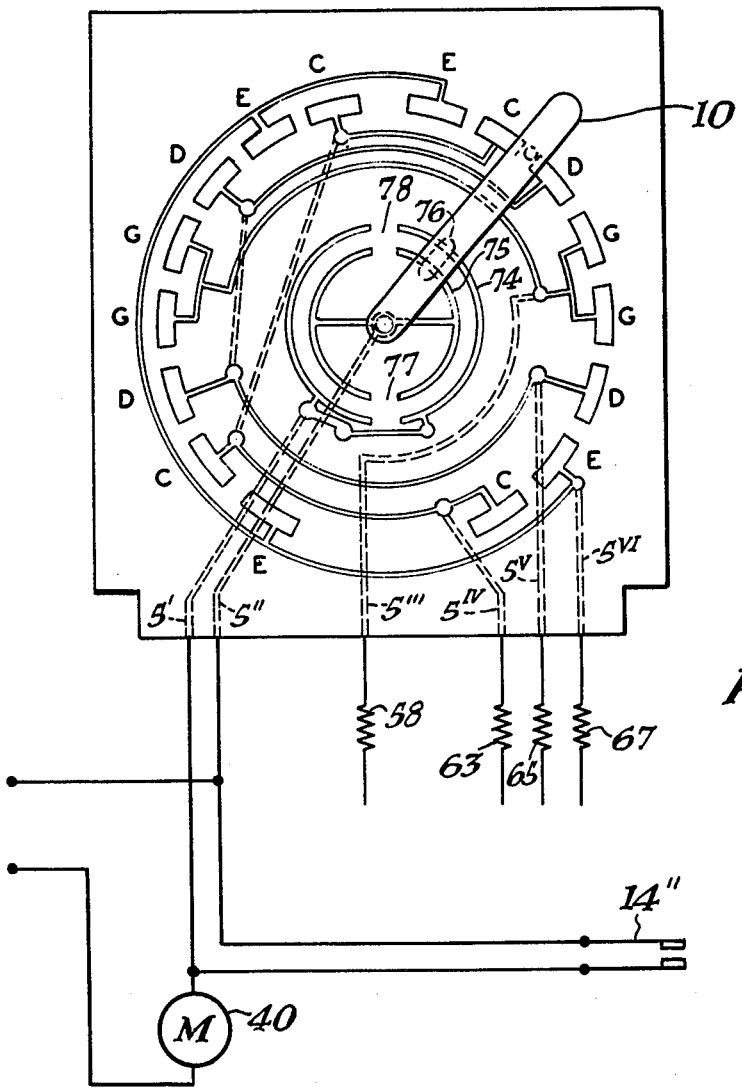
FIG. 6 is another schematic diagram of a second motor trigger circuit and a top view of a melody circuit board or printed board circuit.

In FIG. 6, a printed board circuit is shown and an alternate motor circuit. The edge connectors include in this board 5''', 5IV, 5V and 5VI for selecting tones G resistor 58, C5 resistor 63, D resistor 65 and E resistor 67. The contact areas of the same motors are interconnected. The edge connectors 5''' - 5VI are connected to the contact areas. The printed board circuit may also include an on-off circuit shown as contact areas 74 and 75 that are connected to edge connectors 5' and 5'' respectively. The sweep arm 10 includes a wind band shorting contact 76. The motor 40 will continue to run after switch arm is actuated until a spacing is reached, for example, 77 or 78. This arrangement allows a complete melody to be played during 180° movement of arm 10. Switches 14'' must be held down until contact 76 engages both strips 74–75, which is almost instantaneous.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A replaceable electric melody circuit board record for engagement with an electronic oscillator tone generating means for automatic play of a melody when continuously sweeped by electrical connecting means comprising:

a removable printed circuit board with a playing surface, sequential and variable sized electrically conductive areas of melody control area means on said playing surface to provide a melody in conjunction with an electronic oscillator tone generating means, said melody control area means sized to provide the time length of each tone when sweeped by connecting means, said melody control area means spaced apart to provide the time length of the pause between each note, and said melody control area means oriented in a single path pattern from start to finish for providing a complete melody, the edge of said melody circuit board including connector means interconnected with said melody control area means for sequentially picking up the proper tone when connected to an electronic oscillator tone generating means to provide various melodies from different printed circuit boards.

2. A replaceable electrical melody circuit board record for engagement with an electronic oscillator tone generating means for automatic play of a melody when continuously sweeped by electrical connecting means as set forth in claim 1 wherein, said pattern is a circular pattern, and said melody circuit board record is a single board that is replacable for providing different melodies when a door bell is actuated.

3. A replaceable electrical melody circuit board record for engagement with an electronic oscillator tone generating means for automatic play of a melody when continuously sweeped by electrical connecting means as set forth in claim 1 in combination with;

a musical melody device for producing a plurality of melodies from a plurality of melody circuit board records by actuating a switch means in an electrical circuit including, said switch means in said electrical circuit connectable to a source of power, an electrical tone generating means connected to said switch means, at least one interchangeable said melody circuit board record connectable to said tone generating means, said melody circuit board record connected through said connector means to said tone generating means to produce various tones of a particular musical score of a melody, a connecting means connected for completing said electrical circuit and connected for automatically sequentially sweeping and making contact with said melody control area means, an amplifier means connected to said tone generating means, and a speaker means connected to said amplifier means for automatically producing an audible melody when said switch means is actuated and as said connecting means makes contact.

4. A melody circuit board record combined with a musical melody device as set forth in claim 3 wherein:

said switch means is a door bell actuating means for providing a replaceable melody announcement means for door entry, said melody control area means is a tone selecting means when said melody circuit board is connected by said connector means to said tone generating means, said tone generating means is an electronic oscillator circuit means for producing melody tones, and an automatic drive means connected to said connecting means to drive said connecting means through a cycle of operation to complete the electrical circuit and provide the proper timing.

* * * * *